US007387204B2

(12) United States Patent
Lee

(10) Patent No.: US 7,387,204 B2
(45) Date of Patent: Jun. 17, 2008

(54) PULL-UP TRAY CONTAINER

(75) Inventor: Choon Woo Lee, Flower Mound, TX (US)

(73) Assignee: Bao Sheng Corporation, Kyungki-Do (KR)

( * ) Notice: Subject to any disclaimer, the term of this patent is extended or adjusted under 35 U.S.C. 154(b) by 432 days.

(21) Appl. No.: 10/901,535

(22) Filed: Jul. 29, 2004

(65) Prior Publication Data

US 2005/0056566 A1 Mar. 17, 2005

Related U.S. Application Data

(60) Provisional application No. 60/490,730, filed on Jul. 29, 2003.

(51) Int. Cl.
*B65D 69/00* (2006.01)

(52) U.S. Cl. ..... 206/362; 206/804; 206/817

(58) Field of Classification Search ..... 206/15.3, 206/362, 362.3, 804, 817, 581, 823
See application file for complete search history.

(56) References Cited

U.S. PATENT DOCUMENTS

| | | | | | |
|---|---|---|---|---|---|
| 1,584,261 | A | * | 5/1926 | Vuolo | 206/362.1 |
| 2,487,107 | A | * | 11/1949 | Andrea | 312/73 |
| 2,852,132 | A | * | 9/1958 | Steinberger et al. | 206/362 |
| 3,727,748 | A | * | 4/1973 | Brown | 206/362.1 |
| 4,179,040 | A | * | 12/1979 | Bateman et al. | 220/796 |
| 5,082,135 | A | * | 1/1992 | DeCoster | 220/694 |
| 5,634,569 | A | * | 6/1997 | DeCoster | 220/735 |
| 6,135,279 | A | * | 10/2000 | Dryer | 206/362.1 |

* cited by examiner

*Primary Examiner*—David T Fidei
(74) *Attorney, Agent, or Firm*—Bracewell & Giuliani LLP

(57) ABSTRACT

A cosmetic brush container has a cylindrical sidewall, a closed bottom, and an open top. A tray is carried within the container for axial movement relative to a longitudinal axis of the container from a lower storage position. A lid releasably fits over the top of the container. A rod extends between the tray and the lid. Brushes are carried in the container, with lower ends supported on the tray and bristles supported by the sidewall of the container. Lifting the lid causes the tray to move upward and the bristles of the brushes to move above the top of the container for access by a user.

11 Claims, 2 Drawing Sheets

PULL-UP TRAY CONTAINER

CROSS-REFERENCE TO RELATED APPLICATION

This application claims the benefit of U.S. Provisional application 60/490,730 filed Jul. 29, 2003.

FIELD OF THE INVENTION

This invention relates in general to containers for holding loose items, and in particular to a container with a pull-up tray for holding cosmetic brushes.

BACKGROUND OF THE INVENTION

Often, a person will use a variety of sizes of cosmetic brushes for applying cosmetics. The brushes apply both powdered cosmetics as well as cosmetics in a liquid or paste form. One way to keep the brushes organized and neat in appearance while not in use is to place them in an open-topped container. The lower ends of the brushes are supported on the bottom of the container and the bristles extend above the top.

While workable, other objects or part of the clothing of the user might contact the exposed bristles, causing residual cosmetics on the brushes to transfer to the clothing or other objects. Also, in some cases, bacteria may grow in the residual cosmetics left on the bristles.

SUMMARY OF THE INVENTION

In this invention, an apparatus for storing articles is provided that is particularly appropriate for storing cosmetic brushes. The apparatus includes a container having a sidewall, a closed bottom, and an open top. A tray is carried within the container for axial movement relative to a longitudinal axis of the container. A rod is secured to the tray and extends upward to at least the top of the container.

In use, the brushes are placed in the container with lower ends resting on the tray. When the tray is in the lower position, the bristles of the brushes are supported by the sidewalls of the container below the top. Lifting the rod pulls the tray upward and exposes the bristles of the brushes.

Preferably a lid connects to the rod for movement therewith. When the tray is in a lower position, the lid will engage the top of the container. Also, preferably, the tray has an upper self-supporting position that allows the user to release the rod with the bristles of the brushes being exposed above the top of the container. In one embodiment, an upper shoulder supports the tray to provide this self-supporting position. In this example, mating guides are formed on the interior sidewall of the container and the tray. The upper ends of the guides on the sidewall terminate at the upper shoulder. While the tray is below the upper shoulder, the mating guides prevent rotation of the tray. While above, the user can rotate the tray slightly to misalign the mating guides so that the upper shoulder will support the tray.

Optionally, a chemical treatment material, such as an anti-microbial agent may be located in the container. Preferably, the tray is located above the bottom a selected distance while in a lower position, defining a lower compartment. Also, the tray preferably has perforations. The chemical treatment material is located in the lower compartment and communicates with the brushes via the perforations.

DETAILED DESCRIPTION OF THE INVENTION

Figure 1:
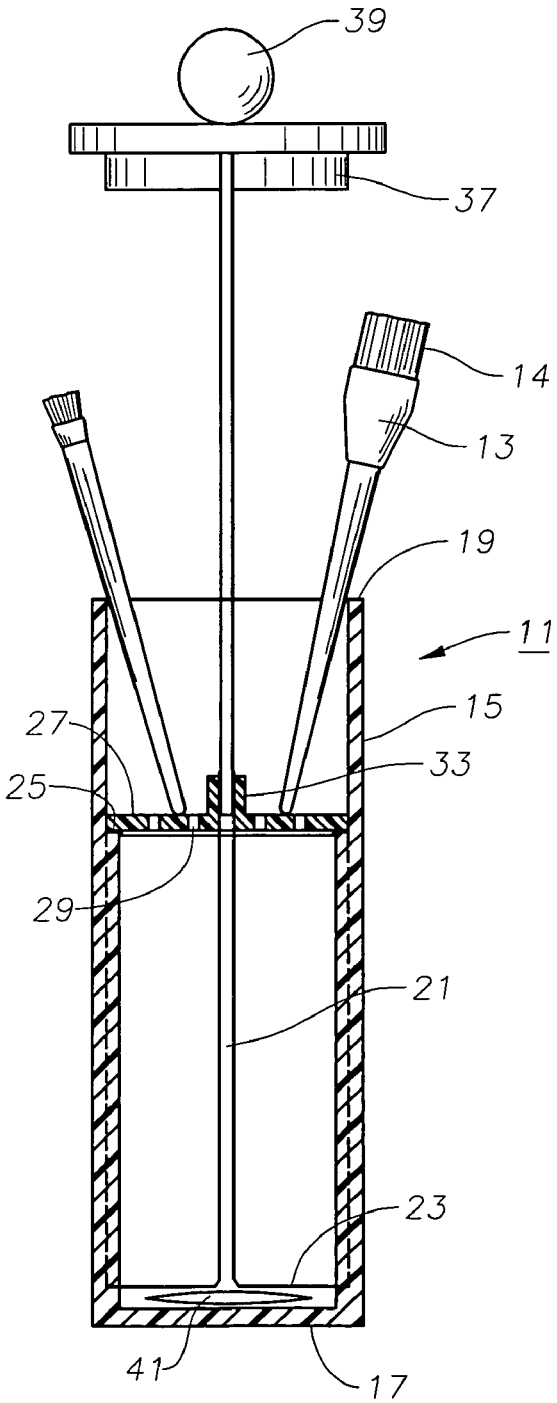
FIG. 1 is a sectional view of a container constructed in accordance with this invention and shown in the open position.

Referring to FIG. 1, container 11 is particularly used for holding cosmetic brushes 13, however, it could be used for holding other items as well. Cosmetic brushes 13 are conventional, each having a handle and a set of bristles 14. Container 11 has a cylindrical sidewall 15 that is preferably of clear plastic material, such as acrylic. Container 11 has a bottom 17 and an open upper end 19.

Figure 3:
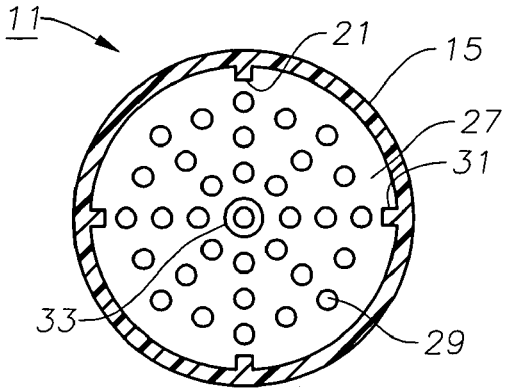
FIG. 3 is a sectional view of the container of FIG. 1, taken along the line 3-3 of FIG. 2.

A plurality of guides or splines 21 are integrally formed in the inner diameter of sidewall 15. Each spline 21 extends longitudinally, parallel with an axis of cylindrical sidewall 15. Each spline 21 protrudes a short distance radially inward from the inner diameter of sidewall 15 and has a narrow width. The number of splines 21 could vary and in the preferred embodiment there are four, each spaced 90° from the other, as shown in FIG. 3. Splines 21 could optionally extend to bottom 17, but preferably terminate at an annular ledge 23, shown in FIG. 6. Ledge 23 is located a short distance above bottom 17 and has the same radial dimension as each spline 21. Ledge 23 extends circumferentially around the inner diameter of sidewall 15.

Figure 4:
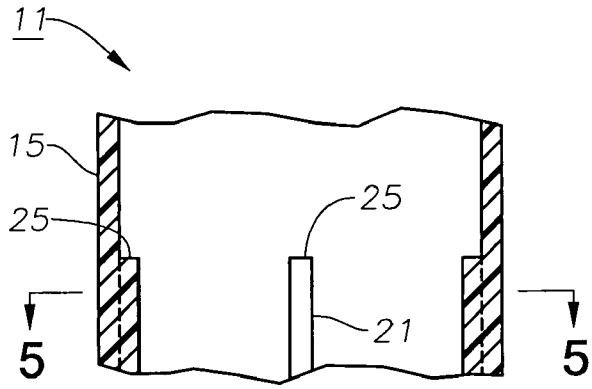
FIG. 4 is a sectional view of a portion of the container of FIG. 1, with the tray shown removed.
Figure 5:
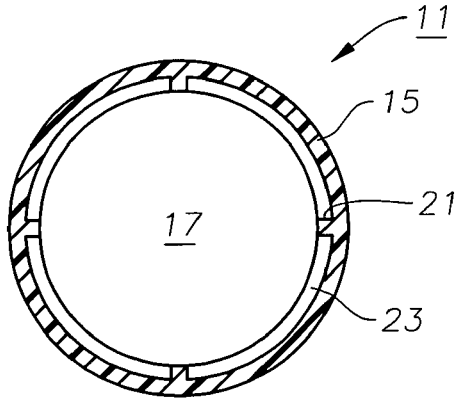
FIG. 5 is a sectional view of the container of FIG. 1, taken along the line 5-5 of FIG. 1.

The upper end 25 of each spline 21, as shown in FIG. 4, is preferably contained in a plane perpendicular to the axis of sidewall 15, defining an upper shoulder. The upper ends 25 of splines 21 are positioned a selected distance below container upper end 19, this distance being selected so that the longest brushes 13 for storage in container 11 will not fall laterally out of container 11, rather their handles will be supported by the open upper end 19 while container 11 is in the open position. The position of the upper ends 25 of splines 21 is also selected so that the tips of the shortest brushes 13 for storage in container 11 will be above upper end 19 while container 11 is in the open position.

Container 11 also includes a tray 27 that supports the lower ends of the handles of brushes 13. Tray 27 is a circular flat disc that has an outer diameter slightly smaller than the inner diameter of sidewall 15. Tray 27 could optionally have a circular wall extending upward a short distance. The outer diameter of tray 27 is larger than the distance between two of the splines 21 located 180° apart from each other. That is, a diameter measured at the inner surfaces of splines 21 is less than the outer diameter of tray 27. In the preferred embodiment, tray 27 has a plurality of perforations or apertures 29 (FIG. 3) that are spaced throughout for ventilation. However, apertures 29 could be eliminated if desired.

Figure 2:
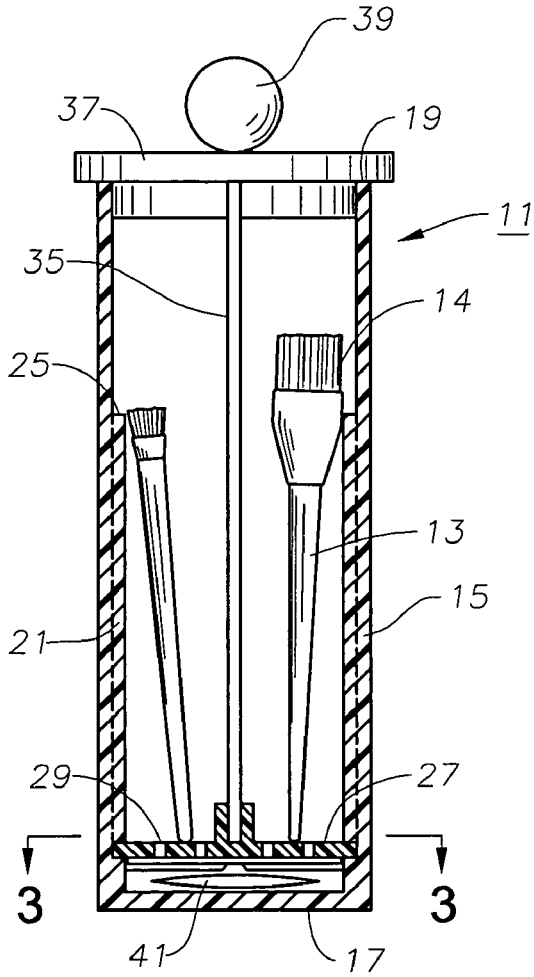
FIG. 2 is a sectional view of the container of FIG. 1, shown in the closed position.

Tray 27 also has a plurality of guides or notches 31 formed in its outer diameter, notches 31 being 90° apart. Each notch 31 has a width slightly greater than the width of one of the splines 21 so that tray 27 will slide freely over splines 21, when registered as shown in FIG. 2. When notches 31 are in registry with splines 21, tray 27 cannot rotate relative to container 11. Because the outer diameter of tray 27 is greater than the inner diameter of splines 21, when tray 27 is above splines 21 and notches 31 are misaligned with splines 21, as shown in FIG. 1, tray 27 can rest on upper ends 25 of splines 21, which serve as a self-supporting shoulder.

Figure 6:
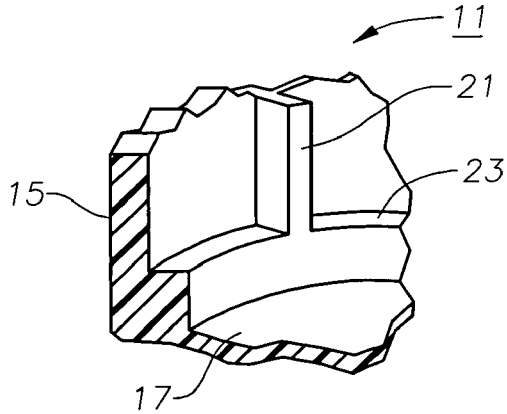
FIG. 6 is a fragmentary perspective view of a lower portion of the container of FIG. 1.

A receptacle 33 is formed on the upper side of tray 27 for securing tray 27 to the lower end of a rod 35. Receptacle 33 is preferably threaded, but rod 35 could be fastened in other ways. Rod 35 extends substantially the length of container 11 and secures to a lid 37 at its upper end. Lid 37 fits within or over container upper end 19 to close container 11. Lid 37 may be a variety of types and may have a knob 39 for manually grasping to lift lid 37. When lid 37 is in the closed position of FIG. 2, tray 27 will be closely spaced to or contacting ledge 23 (FIG. 6). While in the closed position, tray 27 is preferably spaced above container bottom 17, leaving a space or compartment below tray 27 for depositing a chemical material such as an antimicrobial bag 41. Anti-microbial bag 41 is a porous bag having a conventional chemical material that dissipates into the atmosphere within container 11 and retards the growth of bacteria on brushes 13. The chemical agent of antimicrobial bag 41 communicates with bristles 14 via apertures 29.

In operation, container 11 is shown in the closed position in FIG. 2 with brushes 13 located inside and being supported on tray 27. Bristles 14 are below container upper end 19 and typically touching the interior of sidewall 15. Lid 37 closes upper end 19 of container 11. If used, anti-microbial material in bag 41 communicates with any cosmetic residue on brushes 13 via apertures 29 in tray 27.

To access brushes 13, the user grasps knob 39 and lifts rod 35 and lid 37 upward to expose bristles 14. The user could simply hold knob 39 while picking out one of the brushes 13, then lowering lid 37 back on top of container 11. Alternately, the user can place tray 27 in a self-supporting upper position, which leaves bristles 14 of brushes 13 exposed after the user releases knob 39. To do so, the user lifts knob 39 to a point where tray 27 is above upper ends 25 of splines 21. The user then rotates knob 39 and tray 27 an increment less than 90° to misalign tray notches 31 with splines 21. The user then lowers tray 27 until it rests on spline upper ends 25 as shown in FIG. 1. Tray 27 is spaced a significant distance above container bottom 17 in this upper position. At least bristles 14 of the brushes 13 protrude above container upper end 19. Typically the upper portions of at least some of brushes 13 will tilt laterally outward past sidewall 15. Lid 37 remains attached to rod 35 in this embodiment and is spaced above open end 19 a distance proportional to the distance from the closed position of FIG. 1 to the open position of FIG. 2.

The invention has significant advantages. The container retains brushes in an attractive, neat-appearing manner. The container prevents any cosmetic residue from smearing onto other objects while the brushes are stored. The lid and lower compartment allow the use of an anti-microbial agent to retard bacteria growth in the cosmetic residue on the brushes.

While the invention has been shown in only one of its forms, it should be apparent to those skilled in the art that it is no so limited, but is susceptible to various changes without departing from the scope of the invention. For example, rather than being attached to lid 37, rod 35 could optionally be shorter, with knob 39 located below lid 37 while in the closed position. In this alternate arrangement, the user accesses brushes 13 by first removing lid 37, setting it aside, then grasping knob 39 to pull up rod 35 and tray 27. Other types of retention mechanisms could be used to hold tray 27 in the upper position rather than upper ends of splines 21. For example, a hook could extend from one side of tray 27 for hooking over container upper end 19.

The invention claimed is:

1. An apparatus for applying cosmetics, comprising:

a container having a cylindrical sidewall, a closed bottom, and an open top;

a tray carried within the container;

a lid that releasably fits over the top;

a rod extending between the tray and the lid for moving the tray and the lid in unison with each other between a lower position and an upper position, the lid being in contact with the top of the container while in the lower position and spaced above the top of the container while in the upper position; and a plurality of brushes removably carried in the container, each brush having a handle with an end that is supported on the tray while in the lower position and a set of bristles that is supported by the sidewall of the container while the tray is in the lower position, whereby lifting the lid causes the tray to move upward and the bristles of the brushes to move above the top of the container for access by a user.

2. The apparatus according to claim 1, further comprising:

means for supporting the tray and the lid in the upper position.

3. The apparatus according to claim 1, wherein at least one of the brushes is longer than at least one other of the brushes, such that while the tray is in the lower position, the bristles of the brush that is longer will be elevated above the tray a greater height than the bristles of the brush that is shorter.

4. The apparatus according to claim 1, wherein the handles of the brushes are inclined relative to the rod while the tray is in the lower position.

5. The apparatus according to claim 1, wherein the bristles of at least one of the brushes slide against the sidewall while the tray is being moved upward from the lower position.

6. An apparatus for applying cosmetics, comprising:

a container having a cylindrical sidewall, a closed bottom, and an open top;

a tray carried within the container;

a lid that releasably fits over the top;

a rod extending between the tray and the lid for moving the tray and the lid in unison with each other between a lower position and an upper position, the lid closing the top of the container while in the lower position and spaced above the top of the container while in the upper position; and first and second brushes removably carried in the container, each brush having a handle with a lower end that is supported on the tray while in the lower position and an upper end having bristles that is supported by the sidewall of the container while the tray is in the lower position, the upper ends of the brushes being above the top of the container while the tray is in the upper position, the second brush being longer than the first brush, causing the upper end of the second brush to be located a further distance from the tray than the upper end of the first brush while the tray is in the lower position.

7. The apparatus according to claim 6, wherein the handles of the brushes are inclined relative to the rod while the tray is in the lower position.

8. The apparatus according to claim 6, wherein the bristles of at least one of the brushes slide against an interior surface of the sidewall while the tray is being moved upward from the lower position.

9. The apparatus according to claim 6, further comprising means for supporting the tray in the upper position.

10. An apparatus for applying cosmetics, comprising:

a container having a cylindrical sidewall, a closed bottom, and an open top;

a tray carried within the container;

a lid that releasably fits over the top;

a rod extending between the tray and the lid for moving the tray and the lid in unison with each other between a lower position and an upper position, the lid closing the top of the container while in the lower position and spaced above the top of the container while in the upper position; and a plurality of brushes removably carried in the container, each brush supported on the tray in a tilted position, with a lower end in contact with the tray and an upper end in contact with the sidewall of the container while the tray is in the lower position, whereby lifting the lid causes the tray to move upward and the upper ends of the brushes to move above the top of the container for access by a user.

11. The apparatus according to claim 10, further comprising means for supporting the tray in the upper position.

* * * * *